US008398010B2

(12) United States Patent
Tomita et al.

(10) Patent No.: US 8,398,010 B2
(45) Date of Patent: Mar. 19, 2013

(54) POLYESTER MONOFILAMENT PACKAGE

(75) Inventors: Shinnosuke Tomita, Mishima (JP); Hirofumi Yamamoto, Osaka (JP); Kiyoshi Akazawa, Osaka (JP); Takayuki Yoshimiya, Mishima (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 13/521,380

(22) PCT Filed: Jan. 5, 2011

(86) PCT No.: PCT/JP2011/050026

§ 371 (c)(1),
(2), (4) Date: Jul. 10, 2012

(87) PCT Pub. No.: WO2011/086954

PCT Pub. Date: Jul. 21, 2011

(65) Prior Publication Data

US 2012/0280073 A1 Nov. 8, 2012

(30) Foreign Application Priority Data

Jan. 13, 2010 (JP) ..... 2010-005188

(51) Int. Cl.
*B65H 55/04* (2006.01)

(52) U.S. Cl. ..... 242/174

(58) Field of Classification Search ..... 242/174–178; 428/401, 373, 374

See application file for complete search history.

(56) References Cited

U.S. PATENT DOCUMENTS

| | | | |
|---|---|---|---|
| 6,555,220 | B1 | 4/2003 | Koyanagi et al. |
| 2003/0026981 | A1 | 2/2003 | Kato et al. |
| 2003/0108740 | A1 | 6/2003 | Koyanagi et al. |
| 2003/0143395 | A1 | 7/2003 | Koyanagi et al. |
| 2011/0318982 | A1 | 12/2011 | Funatsu et al. |

FOREIGN PATENT DOCUMENTS

| | | | | |
|---|---|---|---|---|
| JP | 60204577 | A | * | 10/1985 |
| JP | 60209013 | A | * | 10/1985 |
| JP | 08199424 | A | * | 8/1996 |
| JP | 08267948 | A | * | 10/1996 |
| JP | 11246118 | A | * | 9/1999 |
| JP | 2001279526 | A | * | 10/2001 |
| JP | 2001355123 | A | * | 12/2001 |
| JP | 2003054149 | A | * | 2/2003 |
| JP | 2004225224 | A | * | 8/2004 |
| JP | 2005126186 | A | * | 5/2005 |
| JP | 2008214842 | A | * | 9/2008 |
| WO | 2010/103986 | | | 9/2010 |

* cited by examiner

*Primary Examiner* — William E Dondero
(74) *Attorney, Agent, or Firm* — DLA Piper LLP (US)

(57) ABSTRACT

A polyester monofilament package is formed by reeling a polyester monofilament comprising polyethylene terephthalate and satisfies all of the following requirements (a) to (d): (a) the coefficient of dynamic friction between yarns of the polyester monofilament being 0.13 μd or less; (b) the package end being in a tapered shape with a taper angle (0) of 75° or less; (c) the variation gradient in unreeling tension (AT) being 0.02 cN/dtex-m or less; and (d) in a part of a reeling thickness of 1 mm in the inner layer of the package, the variation in contraction stress of the polyester monofilament being 3.0 cN/dtex or less.

18 Claims, 3 Drawing Sheets

POLYESTER MONOFILAMENT PACKAGE

RELATED APPLICATIONS

This is a §371 of International Application No. PCT/JP2011/050026, with an international filing date of Jan. 5, 2011, which is based on Japanese Patent Application No. 2010-005188, filed Jan. 13, 2010, the subject matter of which is incorporated by reference

TECHNICAL FIELD

This disclosure relates to a polyester monofilament package with good quality for use as a screen mesh cloth for printing.

BACKGROUND

As woven fabrics for screen printing, mesh woven fabrics composed of natural fibers such as silk or inorganic fibers such as stainless steel have been widely used. However, in recent years, synthetic fiber meshes excellent in flexibility, durability and cost performance are widely used. Among them, monofilaments made of polyesters excellent in dimensional stability and the like are highly suitable for screen mesh cloths. Monofilaments made of polyesters are used also for graphic design printing such as label printing for compact discs, electronic board circuit printing, etc.

In recent years, electronic devices have been making remarkable progress to achieve higher performance and more contact sizes. Accordingly, to respond to the requirements for more compact electronic boards and more precise board circuits constituting electronic devices, the demand for higher-mesh and higher-modulus screen mesh cloths with fewer woven fabric defects is growing. Therefore, as polyester monofilaments satisfying these properties required by screen mesh cloths, it is especially important that the polyester monofilaments have a smaller fineness and a higher modulus and do not cause such defects as bane and weaving bars in the production of screen mesh cloths. Compared with ordinary synthetic fibers, monofilaments have a larger single fiber fineness and a higher modulus are likely to fall or be deformed when they are wound, and the screen mesh cloths are likely to have such defects as bane. Consequently it is desired to establish package techniques capable of improving these defects.

As a monofilament package good in unraveling capability/winding stability and capable of overcoming the bane defect of a screen mesh cloth otherwise caused by the tightening of the winding increasing with the lapse of time after monofilament winding, a package wound like a cheese is disclosed (JP 8-199424 A).

Further, a method for producing a polyester monofilament, in which a high-strength and a high-modulus polyester monofilament capable of being processed into a screen mesh cloth with excellent dimensional stability can be produced easily and efficiently without fiber falling, shaving of the filament and pirn barre is disclosed in JP 2004-225224. In that production method, when a monofilament is spun, stretched and wound by a direct spinning and stretching method, a spindle is disposed with its rotating axis kept perpendicular to the progress direction of the filament running out of the stretching line so that the filament can be wound around a bobbin mounted on the spindle to form a package tapered at both the end portions thereof.

However, though the package of JP 8-199424 A suffers little fiber falling and loosening and can avoid filament breakage at the time of unraveling, a high friction oil with a coefficient of dynamic friction between yarn and mirror finished surface of approx. 0.27 to approx. 0.28 μd is used for winding as a cheese. Consequently, there is a problem that in an attempt to weave a higher-mesh and higher-modulus screen mesh cloth, the filament surfaces are shaved by the reed, to cause a disadvantage that shaving fluff is contained in the woven fabric. Further, though unraveling can be made without filament breakage, the unraveling tension variation cannot be sufficiently inhibited. Consequently, there is a problem that the weaving bars caused by it cannot be avoided. In particular, if smaller-fineness and a higher-modulus filaments are used, the problem of weaving bars is more outstanding, and therefore it is difficult to obtain a high-quality/high-precision screen mesh cloth.

Moreover, JP 2004-225224 merely indicates that the monofilament package form is tapered at both the end portions of the package, and that the taper angle is 30° C. or less (claims 1 and 3). JP 2004-225224 does not describe the package quality and form for inhibiting such defects as shaving fluff, barre and weaving bars in the weaving of the screen mesh cloth described later. Further, JP 2004-225224 does not describe any of the coefficient of dynamic friction between yarn and yarn, unraveling tension variation gradient, filament length per one traversing cycle, the winding width of the innermost layer of the package and the winding diameter of the inner most layer which are important indicators of the package quality and form. The polyester monofilament package disclosed in JP 2004-225224 cannot satisfy the properties required for weaving a screen mesh cloth.

Thus, it could be helpful to provide a monofilament package that does not cause such defects as shaving fluff, bane and weaving bars when weaving a screen mesh cloth.

SUMMARY

We provide a polyester monofilament package that satisfies all of the following requirements (a) to (d):

(a) The coefficient of dynamic friction between filament and filament of the polyester monofilament is 0.13 μd or lower;

(b) The end portions of the package are tapered and the taper angle is 75° or smaller;

(c) The unraveling tension variation gradient ΔT is 0.02 cN/(dtex·m) or smaller; and (d) The wet heat shrinkage stress variation of the polyester filament in the 1 mm winding thickness portion of the inner layer of the package is 3.0 cN/dtex or smaller.

We thus provide a polyester monofilament package capable of being processed into a screen mesh cloth for printing with good quality free from occurrences of such defects as shaving fluff, bane and weaving bars.

Figure 1:
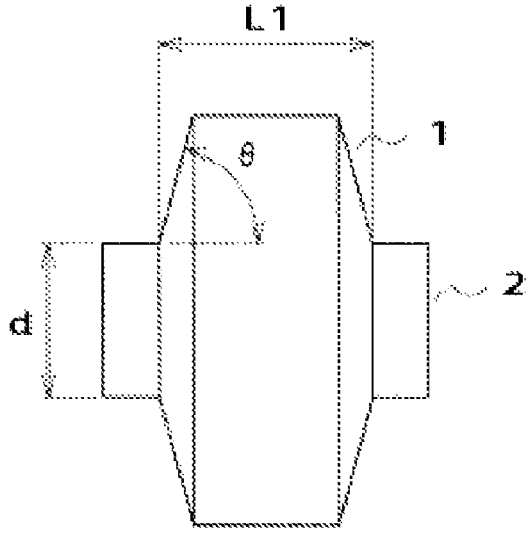
FIG. 1 is a schematic drawing showing a polyester monofilament package.

| REFERENCE SYMBOLS | |
|---|---|
| 1: | polyester monofilament package; |
| 2: | bobbin; |
| 3: | traverse pivot; |
| 4, 54: | traverse guide; |
| 5, 35, 55: | servo motor; |
| 6, 36, 56: | ball screw; |
| 7, 37, 57: | ball nut; |
| 8, 38, 58: | guide; |
| 9, 39, 59: | bracket; |
| 10, 40, 60: | coupling; |
| 11, 41, 61: | induction motor; |
| 12, 42, 62: | spindle; |
| 20: | balancer; |
| 21: | direction turning guide; |
| 22: | rotating roller; |
| 23: | tension meter; |
| 24: | take-up rollers; |
| 33: | filament passage guide; |
| 63: | roller bail; |
| 64: | induction motor; |
| 65: | bracket; |
| 66: | air cylinder; |
| θ: | taper angle; |
| L1: | winding width of the innermost layer of package; |
| L2: | distance between traverse pivot and traverse guide; |
| L3: | filament length difference depending on traverse positions during winding; |
| L4: | distance from return point to twisting portion; |
| d: | winding diameter of the innermost layer of package; |
| D: | diameter of rotating roller; |
| Y: | filament; |
| A: | reciprocating direction of traverse guide; |
| B: | reciprocating direction of spindle. |

DETAILED DESCRIPTION

In the polyethylene terephthalate (hereinafter abbreviated as PET), ethylene terephthalate accounts for 90 mol % or more of repeating units. It is preferred that the intrinsic viscosity (IV) of PET is 0.7 or higher in view of higher strength and higher modulus. More preferred is 0.8 or higher. On the other hand, in view of the flowability of the molten polymer at the time of melt spinning, preferred is 1.4 or lower, and more preferred is 1.3 or lower.

Further, the polyester monofilament can also be a core-sheath type bicomponent structure filament for the purpose of satisfying high strength, high modulus and abrasion resistance. Commonly, to enhance the strength of PET fibers, it is necessary to enhance the orientation degree and crystallinity of the fibers. Accordingly, fibrillation shaving (shaving fluff) is likely to occur. Therefore, in the case where a strength of 6 cN/dtex or more is desired, it is preferred to use a core-sheath type bicomponent structure filament. In the core-sheath type bicomponent structure filament, the intrinsic viscosity (IV) of the PET of the core component serving to provide the strength is only required to be as specified before. It is preferred that the intrinsic viscosity (IV) of the PET of the sheath component is lower than that of the PET of the core component by 0.2 or more since the shaving fluff is unlikely to occur. On the other hand, in view of the stable metering capability in the melt extruder and the spinneret, it is preferred that the intrinsic viscosity (IV) of the sheath component is 0.4 or higher. Since the PET of the sheath component serves to provide the abrasion resistance of the polyester monofilament, it is preferred to add approx. 0.1 to approx. 0.5 wt % of inorganic particles typified by titanium oxide.

Further, in the case where a core-sheath type bicomponent structure filament is used, it is preferred that the core/sheath area ratio is 60/40 to 95/5. As described before, the core component serves to provide the strength and the sheath component serves to provide the abrasion resistance. Therefore, if the area ratio is in this range, both the properties can be satisfied without being impaired. A more preferred range is 70/30 to 90/10.

Furthermore, both the PETs can also contain a comonomer to such an extent that the effects are not impaired. As examples of the comonomer, the acid component can be a bifunctional aromatic carboxylic acid such as isophthalic acid, phthalic acid, dibromoterephthalic acid, naphthalenedicarboxylic acid, diphenyloxyethanecarboxylic acid or oxyethoxybenzoic acid, a bifunctional aliphatic carboxylic acid such as sebacic acid, adipic acid or oxalic acid, or cyclohexanedicarboxylic acid. The glycol component can be propanediol, butanediol, neopentyl glycol, bisphenol A, a polyoxyalkylene glycol such as polyethylene glycol or polypropylene glycol. In addition, as additives, an antioxidant, antistatic agent, plasticizer, ultraviolet light absorber, coloring matter, etc. can also be added as appropriate.

It is preferred that the fineness of the polyester monofilament is 3 to 40 dtex. To design a screen mesh cloth with a mesh number suitable for precision printing, 40 dtex or smaller is preferred. More preferred is 18 dtex or smaller, and further preferred is 10 dtex or smaller. On the other hand, in view of weavability, particularly sufficient weft flight performance, 3 dtex or larger is preferred, and 4 dtex or larger is more preferred.

To endure the load in the weaving process for obtaining a screen mesh cloth from the polyester monofilament and enduring the load acting during screen printing, it is preferred that the strength of the polyester monofilament is 5 cN/dtex or higher. To secure the tenancy level as a screen mesh cloth, it is preferred that the strength is higher when the fineness is smaller. At a fineness of 18 dtex or smaller, 5.5 cN/dtex or higher is more preferred. At a fineness of 10 dtex or smaller, 6 cN/dtex or higher is preferred, and 7.2 cN/dtex or higher is further preferred. A strength of 8.5 cN/dtex or higher is the most preferred. A higher strength is preferred, but in general, elongation declines at a higher strength. Therefore, to secure an elongation good for weavability, 10 cN/dtex or lower is preferred. The value of strength can be adjusted as appropriate in reference to the necessary properties of the screen mesh cloth.

To enhance the printing precision of the screen mesh cloth, it is preferred that the 10% modulus of the polyester monofilament is 3.6 cN/dtex or higher. The 10% modulus is obtained by dividing the load at the time of 10% elongation in a tension test by the fineness and expresses the stiffness of the monofilament. At a smaller fineness, it is preferred that the 10% modulus is higher, that is, a higher modulus is preferred. At 18 dtex or smaller, 4.0 cN/dtex or higher is more preferred. At a fineness of 10 dtex or smaller, 5.0 cN/dtex or higher is more preferred. Further preferred is 6.0 cN/dtex or higher, and the most preferred is 7.5 cN/dtex or higher.

The coefficient of dynamic friction between filament and filament of the polyester monofilament is 0.13 μd or lower. If the coefficient of dynamic friction between filament and filament is higher, package deformation and end-face fiber falling are unlikely to occur during package formation and package transport, but shaving fluff is likely to occur during weaving. If the coefficient of dynamic friction between filament and filament is 0.13 μd or lower, shaving of the filament can be inhibited. A preferred range is 0.05 to 0.10 μd. If the coefficient of dynamic friction is in this range, shaving of the filament occurs less and the fiber falling at package end faces, package deformation and the like are unlikely to occur, allowing the filament to be wound into a well-formed package.

The polyester monofilament package has an end-face taper angle θ of 75° or smaller. The end-face taper angle refers to the angle (acute angle) formed between the central axis direction of the winding center and the slope line direction of each of the end faces when observed from a lateral face of the polyester monofilament package. Specifically, the end-face taper angle is the angle corresponding to θ of FIG. 1. A monofilament has a larger single filament fineness and a higher modulus than so-called ordinary fibers and, therefore, is likely to fall from package end face portions. Especially in the case where the coefficient of dynamic friction between filament and filament is low, fiber falling is remarkable. Therefore, the taper angle θ is kept at 75° or smaller, to inhibit fiber falling. Preferred is 60° or smaller, and more preferred is 45° or smaller. It is preferred in view of industrial production that the lower limit of taper angle θ is 5° or larger since the amount of the filament that can be wound per package becomes larger.

The unraveling tension variation gradient ΔT when the polyester monofilament is unraveled from the polyester monofilament package is 0.02 cN/(dtex·m) or smaller. The unraveling tension in this case refers to the tension of the filament unraveled from a horizontally placed stationary package in the central axis direction of the winding center and passing at a speed of 200 m/min through the unraveling guide installed at a distance of 10 cm from the winding center along the extension of the central axis of the winding center. Meanwhile, the filament unraveling method from the package can be either the aforementioned method of unraveling in the axial direction of the winding center or a method of unraveling in the direction almost perpendicular to the winding center axis while the package is rotated. However, in the weaving of monofilaments, the former method is excellent in view of both device simplicity and easy unraveled filament tension adjustment. Usually, the unraveling tension is lower when the filament is unraveled from the portion on this side of the package than when it is unraveled from the portion on the depth side of the package. The unraveling tension variation refers to the tension difference between the maximum value (on the depth side of the package) and the minimum value (on this side of the package) alternately appearing when the unraveling tension is continuously monitored. The unraveling tension variation gradient ΔT refers to the value obtained by dividing the tension difference by the filament length corresponding to the tension difference and the filament fineness.

The unraveling tension variation in the process for producing a screen mesh cloth from screen mesh cloth-use monofilaments having a higher modulus than ordinary fibers cannot be absorbed by a tension control device such as a tensor, and quality defects such as loosening and contraction in the warping step and weaving bars and the like at the time of weft inserting during weaving are likely to occur. However, if the unraveling tension variation gradient ΔT is kept small even though the unraveling tension variation remains equivalent, the capability of the tension control device to follow the variation substantially rises and quality defects become unlikely to occur. Therefore, the unraveling tension variation gradient ΔT is 0.02 cN/(dtex·m) or smaller. Preferred is 0.01 cN/(dtex·m) or smaller, and more preferred is 0.005 cN/(dtex·m) or smaller.

As a method for keeping the unraveling tension variation gradient ΔT small, it is preferred that the package form satisfies at least either of the following (1) and (2):

(1) The filament length wound per one traversing cycle in a package (one traversing cycle filament length) is 25 m or more.

(2) The winding width of the innermost layer of the package is 150 to 300 mm.

The unraveling tension difference between this side and the depth side is smaller when the winding width of the package is smaller. Consequently it is preferred that the inner layer winding width (L1) of the package is 300 mm or smaller. Further, to make the amount of winding per package larger, it is preferred that the inner most layer winding width (L1) of the package is 150 mm or larger.

In the polyester monofilament package, the wet heat shrinkage stress variation of the polyester monofilament in the filament length direction in the 1 mm winding thickness portion of the inner layer of the package is 3.0 cN/dtex or smaller. In this case, the wet heat shrinkage stress variation in the filament length direction refers to the value obtained by dividing the difference between the maximum tension value and the minimum tension value of a continuously monitored filament length corresponding to one traversing cycle or longer by the fineness of the filament, by using a device provided with a region to be given wet heat and a tension meter between two pairs of rollers respectively running at a speed of 10 m/min. A screen mesh cloth-use polyester monofilament with a strength and a modulus respectively higher than those of ordinary fibers is likely to suffer stress relaxation (shrinkage) after completion of winding, since the orientation degree of the amorphous region of PET is large. The stress relaxation causes the filament to shrink, and the tightening of the winding toward the center of the package occurs. If the tightening of the winding does not take place uniformly in the package as a whole, causing differences in the filament length direction, defects like barre are caused in the screen mesh cloth. The stress relaxation state can be confirmed by measuring the stress generated when the filament is made shrunken with wet heat. If the stresses at the time of wet heat shrinkage are different in the filament length direction, it indicates that stress relaxation takes place in some portions while stress relaxation does not take place in other portions. Meanwhile, the reason why the wet heat shrinkage stress variation in the 1 mm winding thickness portion, i.e., in the innermost layer of the package is measured is as follows. Inside just below the filament portion in the innermost layer of the package, a bobbin exists to inhibit the shrinkage of the filament, and the stress relaxation is unlikely to occur. Accordingly, the shrinkage stress variation in the filament length direction becomes the largest among the package. For this reason, it is necessary to specify the wet heat shrinkage stress variation of the innermost layer of the package for adaptation to the property required when the screen mesh cloth is produced by weaving. If the stress difference at the time of wet heat shrinkage is more than 3.0 cN/dtex, bane is likely to occur. Preferred is 1.5 cN/dtex or less, and more preferred is 0.8 cN/dtex or less. Especially preferred is 0.3 cN/dtex or less.

It is preferred that the monofilament wound as the polyester monofilament package is 4 count/m or less as the residual torque obtained by a residual torque test. The residual torque in this case refers to the value obtained by unraveling a monofilament in the direction perpendicular to the winding center axis of the package such that the monofilament may not be twisted, folding the monofilament double using a pin as a pivot, to prepare a 1 m sample, fixing the ends of the monofilament, removing the pin for allowing the monofilament to turn, and counting the caused twist. If the residual torque is 4 count/m or less, the unraveling snarl in the warping step can be inhibited, and the phenomenon that the polyester monofilament is wound into the warp beam is unlikely to occur, allowing the appearance quality of the screen mesh cloth to be enhanced. It is preferred that the residual torque is smaller, i.e., closer to 0. More preferred is 2 count/m or less.

It is preferred that the winding diameter (d) of the innermost layer of the polyester monofilament package is 75 to 200 mm. If the winding diameter (d) of the innermost layer is 75 mm or larger, the twist caused by unraveling is small, and the same effect as that obtained by decreasing the aforementioned residual torque can be obtained. In addition, since the tightening force by the stress relaxation/shrinkage of the wound monofilament is dispersed, the stress difference at the time of wet heat shrinkage is likely to be decreased. On the other hand, it is preferred that the winding diameter (d) of the innermost layer is 200 mm or smaller, since the package size becomes small to enhance the handling efficiency. More preferred is 150 mm or smaller.

The method for producing the polyester monofilament package is explained below. The process for producing the polyester monofilament package comprises three major steps: a spinning step of melting PET, discharging from a spinneret, cooling and taking up by a roller with a constant speed, a stretching step of stretching/heat-treating the taken-up non-stretched monofilament, and a winding step of winding the stretched monofilament, to form a package.

For the spinning step, a known melt spinning method can be employed, and the PET molten by an extruder is supplied to a spinneret using a metering pump to achieve a desired fineness, then a monofilament being discharged. It is preferred that melt spinning temperature is 280 to 310° C. to sufficiently melt the PET and inhibit thermal decomposition otherwise caused by excessive heating. In the case of a known core-sheath type bicomponent structure filament, two extruders are used to melt and meter the core and the sheath separately, and both the components are conjugated by a known sheath-core conjugate spinneret and subsequently discharged. For the purpose of inhibiting and making uniform the orientation of the monofilament, a heating cylinder may also be used in the region before the discharged monofilament is cooled. In the case where the heating cylinder is used, it is preferred that the atmosphere temperature in the heating cylinder is 200 to 330° C. If the atmosphere temperature in the heating cylinder is 200° C. or higher, the effect of the heating cylinder can be sufficiently obtained. If the atmosphere temperature in the heating cylinder is 330° C. or lower, the monofilament diameter irregularity in the filament length direction can be inhibited. As the cooling method, it is preferred to employ cooling by chimney air. For cooling by chimney air, for example, a method of spraying in one direction almost perpendicular to the filament running direction or a method of spraying in the directions almost perpendicular to the running filament from the entire circumference can be used. Before the cooled monofilament is taken up by a roller, it is preferred to add a spinning oil. The chemical composition of the spinning oil is not especially limited, but to enhance the smoothness and inhibit shaving fluff when weaving the screen mesh cloth, it is preferred to use an oil containing 30% or more of a fatty acid ester-based smoothing agent. Further, it is preferred that approx. 0.1 to approx. 5% of a polyether-modified silicone is added to the oil since the smoothness can be further enhanced. The oil can be mixed with water to form an emulsion, and the emulsion can be applied to the monofilament by using an oil supply guide or oiling roller. In this case, it is preferred that the supplied amount of the oil is such that the amount of the oil deposited on the stretched monofilament may be 0.1 to 2.0% based on the amount of the stretched monofilament for such reasons that smoothness becomes good and that the fiber falling from the package formed and package deformation can be inhibited. The oiled monofilament is preferably taken up by a take-up roller with a surface speed of 300 to 3000 m/min. Then, a two-step method of winding once as a non-stretched monofilament and subsequently stretching or a direct spinning stretching method of supplying the monofilament to the stretching step without winding once can be used. In view of production efficiency and orientation uniformity of the obtained monofilament, a direct spinning stretching method is preferred.

In the stretching step, for the purpose of uniform stretching, it is preferred to employ the method of applying the monofilament to a hot roller heated to higher than the glass transition point and in succession to another hot roller with a surface speed higher than that of the first hot roller and heated to higher than the crystallization temperature, to stretch the monofilament. The temperatures and the stretching ratios of the hot rollers can be selected in reference to the intended physical properties. For example, in the case where a high strength and a high modulus are desired, it is preferred that the surface temperature of the final roller is 120° C. or higher, more preferably 200° C. or higher, and that the stretching ratio is 4 to 6 times. Further, it is more preferred to install a hot roller between the hot rollers, to perform multistage stretching, since stretching uniformity can be enhanced. In the case of multistage stretching, the stretching ratio of the first stage is 0.5 to 0.9 time the total stretching ratio. Moreover, between the final hot roller and the winding portion, a cold roller can also be installed. In the case where the speed of the cold roller is higher than that of the final hot roller, since the modulus of the obtained monofilament becomes higher, the printing precision of the screen mesh cloth can be easily enhanced. In the case where the speed of the cold roller is lower than that of the final hot roller, the modulus of the obtained monofilament declines, but the stress difference at the time of wet heat shrinkage decreases, while the shaving fluff during weaving is unlikely to occur. The speed difference between the final hot roller and the cold roller can be adjusted in response to desired properties. It is preferred that the speed of the cold roller is −7 to 2% based on the speed of the final hot roller.

In the winding step, the stretched monofilament is wound according to the following winding method to obtain the desired package. At first, the method of making the package end faces tapered is not especially limited and, for example, the winding method described in JP 2002-284447 A can be used. Specifically in a filament winding machine in which while a filament is continuously wound around a bobbin mounted on a spindle, the filament is traversed alternately in both directions relative to the bobbin axis direction by a traverse guide (claim 1), employed is either a method of traversing the filament alternately in both directions by a traverse guide with the spindle kept stationary (claim 4) or a method of traversing a spindle alternately in both directions with the filament feeding position kept stationary (claim 5). In either method, the traverse width in which alternate traversing in both directions is performed from the start of winding to the end of winding is gradually decreased to achieve a desired taper angle, thereby forming a pirn-like package around the bobbin (paragraph [0015]). Further, it is preferred that the width of the first traversing cycle at the start of winding and the traversing speed can be set to ensure that the winding width of the innermost layer of the package and the filament length per one traversing cycle may be a desired winding width and a desired filament length respectively.

Further, as the polyester monofilament winding method, to keep residual torque small, it is preferred to employ a method of winding the monofilament around the bobbin mounted on a spindle with its rotating axis kept perpendicular to the progress direction of the monofilament running out of the stretching step, instead of employing the known ring twister method. The reason is that, in the ring twister method in general, the monofilament is traversed in the bobbin axis direction by a ring, and a traveler installed on the ring rotatably in the circumferential direction of the bobbin is used to turn the monofilament running direction by 90° for winding around the bobbin. Stroking by the traveler in this case twists the monofilament to make the residual torque large.

Meanwhile, it is preferred to decrease the stress different at the time of wet heat shrinkage in the filament length direction that the winding tension when the polyester monofilament is wound as a package is 0.1 to 0.7 cN/dtex. The reason is that, as described before, since the stress relaxation (shrinkage) is more likely to be caused in our polyester monofilament after completion of winding than in ordinary fibers, a high winding tension makes the stress difference large. Consequently, a preferred range is 0.1 to 0.5 cN/dtex and a more preferred range is 0.1 to 0.3 cN/dtex.

Meanwhile, with regard to the polyester monofilament, it is preferred that the package surface is not pressed during winding. The polyester monofilament is likely to fall from package end faces as described before and, consequently, if the package surface is pressed during winding, falling of the filament is encouraged. However, in the case where a roller with a rotating axis almost parallel to the rotating axis of the bobbin, so-called "touch roller" or "roller bail" or the like is pressed to the package surface during winding, it is preferred that the pressing pressure per unit length of the contact length between the package surface and the roller is kept at 60 gf/cm or lower in the period from the start to end of winding. More preferred is 30 gf/cm or lower. Meanwhile, since the end portions of the package are tapered, the contact length between the package surface and the roller becomes gradually shorter as the package is thickened with winding. Therefore, to keep the pressing pressure of the roller in a preferred pressing pressure range, the pressing pressure can also be adjusted continuously or stepwise during winding.

Further, in the case where the supplied monofilament is wound around the bobbin via the surface of a roller, it is preferred that the roller is directly or indirectly connected with a motor to positively drive the roller separately from the bobbin holder. It is desirable that the driven speed of the roller is such that the surface speed of the roller is 1.00 to 1.10 times the surface speed of the package. A more desirable range is 1.05 to 1.08 times the surface speed of the package. In the case where the surface speed of the roller is less than 1.00 time the package speed, for example, in the case where the roller is not connected with a motor and is rotated only by the frictional force between the so-called "package surface" and the roller surface, the roller surface speed becomes smaller than the package surface speed since slip occurs between the package surface and the roller surface. For this reason, the monofilament wound around the bobbin via the roller surface is stretched between the roller and the package to raise the winding tension, and the stress difference at the time of wet heat shrinkage becomes large as described before. On the contrary, if the roller surface speed is higher than 1.10 times the package surface speed, the tension between the roller and the package is so low that the monofilament is wound loosely. Consequently, the package may be deformed during winding.

Figure 2:
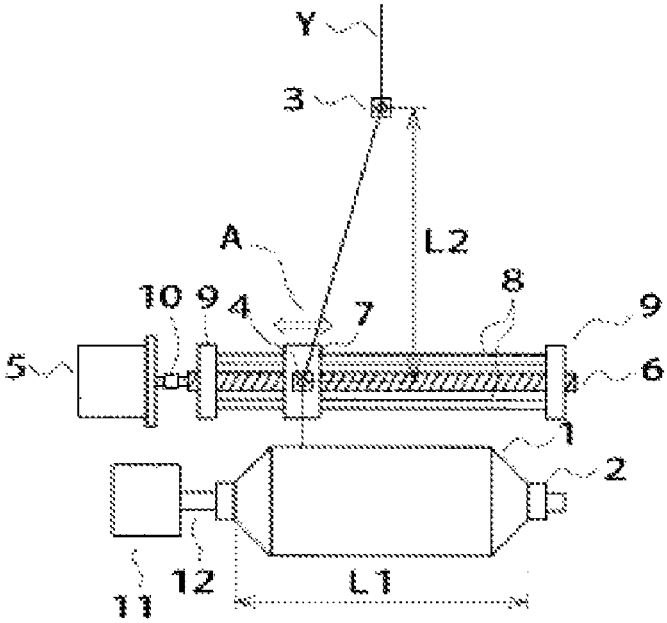
FIG. 2 is a drawing for illustrating the method of winding while reciprocating a supplied filament Y horizontally by using a traverse guide.
Figure 3:
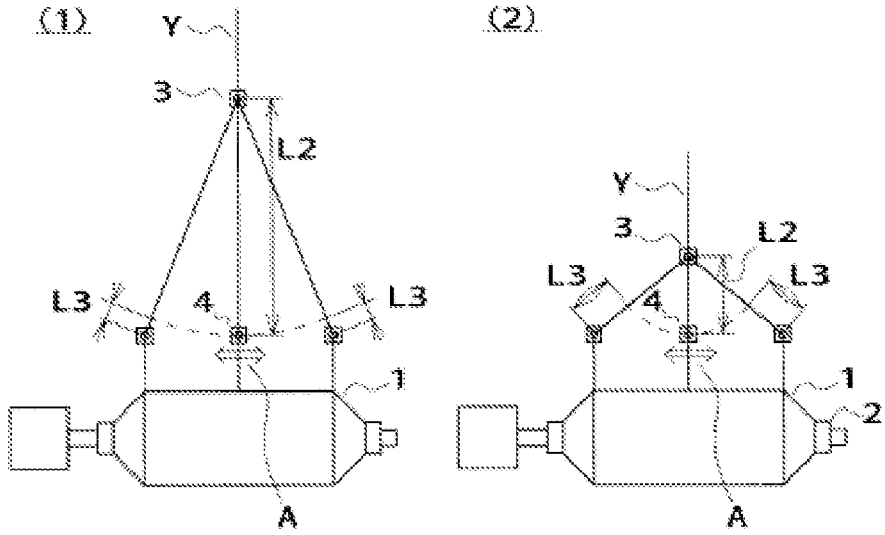
FIG. 3 is a drawing for comparing the difference of filament lengths when the distance from the traverse pivot to the traverse guide is changed.

Further, in the case where the polyester monofilament is wound by the method of reciprocating the supplied monofilament (Y) horizontally by a traverse guide (4) with a traverse pivot (3) as the center as shown in FIG. 2, it is preferred that the distance (L2) between the traverse pivot (3) and the traverse guide (4) is 4 times or more of the winding width (L1) of the innermost layer of the package. Since the polyester monofilament is high in 10% modulus as described before, a slight filament length difference in the process greatly changes the winding tension, and the stress difference at the time of wet heat shrinkage in the filament length direction becomes large. FIG. 3 (1) shows a case where the distance (L2) between the traverse pivot (3) and the traverse guide (4) is long, and FIG. 3 (2) shows a case where the distance (L2) is short. As shown in FIG. 3, if the distance (L2) from the traverse pivot (3) to the traverse guide (4) is shorter, the difference (L3) between the filament length resulting when the traverse guide (4) is at the central position of the package during winding and the filament length resulting when the traverse guide (4) is at either of the package ends becomes larger, and as a result, the wet heat stress difference becomes larger. The distance (L2) is desired to be longer, but in view of layout restriction, a distance corresponding to 4 to 10 times the winding width of the innermost layer of the package is adequate. A preferred range is 8 to 10 times. Further, from this point of view, a method of winding without traversing, that is, the winding method described in claim 5 of the aforementioned JP 2002-284447 A is more preferred.

EXAMPLES

Our polyester monofilament packages and methods are explained below in more detail in reference to examples. Meanwhile, evaluations in the examples were performed according to the following methods.

(1) Intrinsic Viscosity (IV)

Zero point eight grams of a sample polymer was dissolved into 10 mL of o-chlorophenol with a purity of 98% or more, and the relative viscosity (ηr) was obtained from the following formula using an Ostwald viscometer at a temperature of 25° C. The intrinsic viscosity (IV) was calculated from the following formula using the relative viscosity (ηr).

$$\eta r=\eta/\eta 0=(t\times d)/(t0\times d0)$$

$$\text{Intrinsic viscosity (IV)}=0.0242\eta r+0.2634$$

where

η: Viscosity of the polymer solution

η0: Viscosity of o-chlorophenol t: Drop time of the solution (sec)

d: Density of the solution (g/cm$^3$)

t0: Drop time of o-chlorophenol (sec)

d0: Density of o-chlorophenol (g/cm$^3$)

(2) Coefficient of Dynamic Friction Between Filament and Filament

Figure 4:
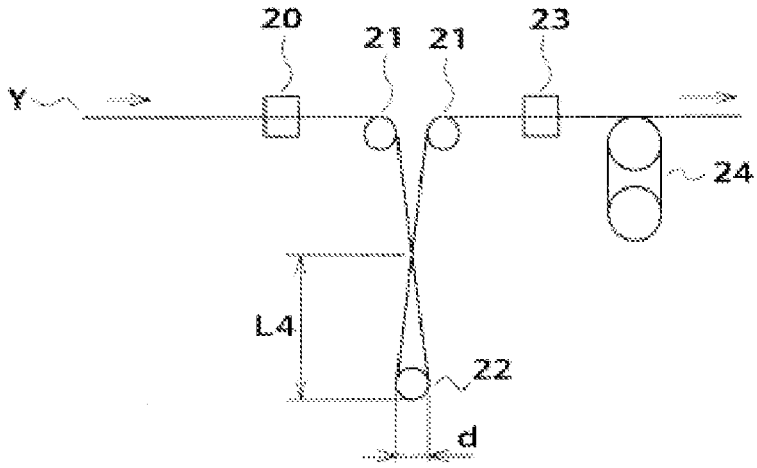
FIG. 4 is a drawing for illustrating the method of measuring the coefficient of dynamic friction between yarn and yarn.

A monofilament and a monofilament were twisted together while being run by a running yarn method, for measurement. That is, as shown in FIG. 4, monofilaments (Y) unraveled from packages (not shown in the drawing) via unraveling guides (not shown in the drawing) were loaded with a load (T1) (=10 g) by a balancer (20) and subsequently twisted twice between direction turning guides (21) and a rotating roller (22). Then, the filaments were fed through a tension meter (23) and taken up by take-up rollers (24). The monofilaments (Y) were unraveled to run at 55 m/min, for measuring T2 by the tension meter (23). The dynamic friction coefficient was calculated from the following formula.

$$\text{Coefficient of dynamic friction between filament and filament } (\mu d)=1/(2\pi n\cdot\sin\beta)\times 1/\log e\times\log(T2/T1)$$

n: Twisting count

β: Twist angle (Diameter (D) of rotating roller/Distance (L4) from return point to twisting portion)

e: Natural logarithm (2.71828)

(3) Unraveling Tension Variation Gradient ΔT

A monofilament was unraveled from an obtained drum-like package with an unraveling distance of 10 cm kept between the drum end and a first unraveling guide at an unraveling speed of 200 m/min. The monofilament tension at the time of unraveling was measured at a position of 20 cm from the first unraveling guide. The tension variation of the monofilament unraveled from a layer with a winding thickness of 5 mm was charted continuously. The difference (cN) between the maximum value and the minimum value alternately appearing on the chart was divided by the filament length (m) corresponding to the tension difference and the monofilament fineness, to obtain the unraveling tension variation gradient ΔT (cN/(dtex·m)).

(4) Wet Heat Shrinkage Stress Variation

The filament thermal analysis system (simply called FTA-500) produced by Toray Industries, Inc. was used to measure the monofilament unraveled from a layer with a winding thickness of 1 mm under the following measuring conditions, and the shrinkage stress caused in the monofilament by heat shrinkage was continuously measured by a tension meter and charted. The difference (cN) between the maximum stress and the minimum stress on the chart was read, and the value was divided by the monofilament fineness, to obtain the wet heat shrinkage stress variation (cN/dtex).

Wet heat temperature: 100° C.

Monofilament supply speed: 10 m/min

Supplied filament length: 400 m (5) Fineness

Five hundred meters of a monofilament was taken as a hank, and the weight of the hank was multiplied by 20, to obtain the fineness.

(6) Strength, 10% Modulus

The load at breakage measured by using Tensilon UCT-100 produced by Orientec Co., Ltd. according to JIS L 1013 (1999) was divided by the fineness, to obtain the strength, and the load at 10% elongation was divided by the fineness, to obtain the 10% modulus.

(7) Residual Torque

A monofilament as a test sample was folded double like U-shape with a pin as a pivot such that the monofilament might not be twisted by unraveling and might not be untwisted, and both the upper ends were fixed to ensure that the sample length at an initial load of 0.1 cN/dtex might be 1 m. A slight load of 0.4 cN/dtex was applied to the sample portion of the support pin, and the support pin was removed from the test sample. The sample as suspended was allowed to self-turn. After the sample stopped self-turning, the number of turns was measured as the torque. The same sample was measured ten times, and the mean value calculated from the measured values was expressed in "count/m". Meanwhile, the measuring atmosphere was temperature 20° C. and relative humidity 65%.

(8) Unraveling Capability

Ten wound polyester monofilament packages were placed side by side on a creel at intervals of 30 cm, and the unraveled monofilaments pulled from the ends of the packages were introduced into a reed and placed side by side at equal intervals in a width of 5 mm, being taken up by a roller at a speed of 100 m/min. The number of unraveled monofilament breaking times after 10-hour continuous unraveling and the states of monofilament deviation after the outlet of the reed were evaluated according to the following criterion. Acceptable levels are A, B and C.

A: Monofilaments neither deviated nor were broken.

B: Monofilaments vibrated, but neither deviated nor were broken.

C: Monofilaments were likely to deviate but soon recovered, and were not broken.

D: Monofilaments almost remained deviating or were broken.

(9) Fiber Falling from Package

Both the end faces of each wound polyester monofilament package were visually checked to count the average fiber falling events per package (N=10). Acceptable levels are A, B and C.

A: There was no fiber falling event.

B: One or two minor fiber falling events of less than 1 cm length

C: Three to five minor fiber falling events of less than 1 cm length

D: There was a fiber falling event of 1 cm or longer length, or there were six or more minor fiber falling events of less than 1 cm length.

(10) Shaving Fluff

A Sulzer loom was used to produce each mesh woven fabric with a width of 2.54 m and an overall length of 30 m at a loom rotating speed of 120 rpm and at any of the following densities. The obtained screen mesh cloth was inspected to visually evaluate the number of shaving fluff pieces. Acceptable levels are A, B and C. Meanwhile, this evaluation was not performed in Examples 11 to 26 or Comparative Examples 4 to 10 described later where the packages were available as weft only.

Fineness 13 dtex: Density 300 monofilaments/2.54 cm

Fineness 8 dtex: Density 380 monofilaments/2.54 cm

Fineness 5 dtex: Density 420 monofilaments/2.54 cm

A: 0 to 1 piece/30 m

B: 2 to 3 pieces/30 m

C: 4 to 6 pieces/30 m

D: 7 pieces or more/30 m

(11) Barre and Weaving Bars

A Sulzer loom was used to produce each mesh woven fabric with a width of 2.54 m and an overall length of 30 m at a loom rotating speed of 120 rpm. The obtained screen mesh cloth was inspected to visually evaluate barre and weaving bars. Acceptable levels are A, B and C. Meanwhile, in Examples 11 to 26 and Comparative Examples 4 to 10 described later where the packages were available as weft only, for the fineness of 13 dtex, the package of Example 1 was used as warp; for the fineness of 8 dtex, the package of Example 4 was used as warp; and for the fineness of 5 dtex, the package of Example 7 was used as warp.

Fineness 13 dtex: Density 300 monofilaments/2.54 cm

Fineness 8 dtex: Density 380 monofilaments/2.54 cm

Fineness 5 dtex: Density 420 monofilaments/2.54 cm

A: There was no barre/weaving bar at all.

B: There were slight barre/weaving bars, and more than 0% to 10% of the entire length was not commercially acceptable.

C: There were slight barre/weaving bars and more than 10% to 30% of the entire length was not commercially acceptable.

D: There were significant barre/weaving bars, or there were slight barre/weaving bars and more than 30% of the entire length was not commercially acceptable.

(12) Evaluation of Printing

A mesh woven fabric obtained from the polyester monofilament package obtained in any of Examples 1 to 7 was installed in a screen mesh cloth frame of 30 cm×30 cm, and a stripe pattern of the following width was printed. The printed state was confirmed by a scanning electron microscope.

Stripe Line Width

Fineness 13 dtex: 200 μm

Fineness 5 dtex, 8 dtex: 100 μm

A: The line thickness variation was less than 10% of the line width.

B: The line thickness variation was 10% to less than 20% of the line width.

C: The line thickness variation was 20% to less than 30% of the line width.

Example 1

A PET having an intrinsic viscosity (IV) of 0.78 and containing 0.5 wt % of titanium oxide, polymerized and pelletized by conventional methods, was melted by an extruder.

Then, the molten polymer was passed through a piping provided in a spin block kept at a temperature of 295° C. and a metering pump for metering a desired polymer flow rate and was introduced into a spin pack. In the spin pack, a filter and a known spinneret were provided in this order. From the spinneret, a monofilament was spun.

In this case, the monofilament spun from the spinneret was passed through a heating cylinder having a length of 100 mm in the axial center direction and an inner diameter of 89 mm, positioned with a distance of 191 mm kept between the spinneret surface and the bottom end of the heating cylinder and with the atmospheric temperature in the heating cylinder kept at 273° C. Then, air of 25° C. was sprayed to the monofilament at an air velocity of 20 m/min in one direction almost perpendicular to the monofilament using a cooling machine, to cool and solidify the monofilament. A spinning oil was supplied to the cooled and solidified monofilament by an oiling roller, to deposit 0.3% based on the amount of the stretched monofilament.

The oil was an emulsion in which a mixed oil comprising 50% of a known fatty acid ester-based smoothing agent, 1% of a water soluble polyether-modified silicone, and a known metal abrasive, an antistatic agent and a surfactant was emulsified at a concentration of 10% in distilled water.

The oiled monofilament was taken up as it was by a take-up roll with a surface speed of 800 m/min. Subsequently without being once wound, it was guided along a first hot roll with a surface temperature of 90° C. and with a surface speed of 808 m/min, a second hot roll with a surface temperature of 90° C. and with a surface speed of 2840 m/min, a third hot roll with a surface temperature of 140° C. and with a surface speed of 3520 m/min and a godet roll with a surface speed of 3520 m/min, and then wound by a filament winding device controlled at a winding tension of 0.2 cN/dtex. The obtained polyester monofilament package had a monofilament fineness of 13 dtex and was tapered at the end portions of the package with a taper angle of 40°, being 100 m in one traversing cycle filament length, 250 mm in the winding width of the innermost layer of the package, 75 mm in the winding diameter of the innermost layer of the package and 2.0 kg in the weight of the winding.

Figure 5:
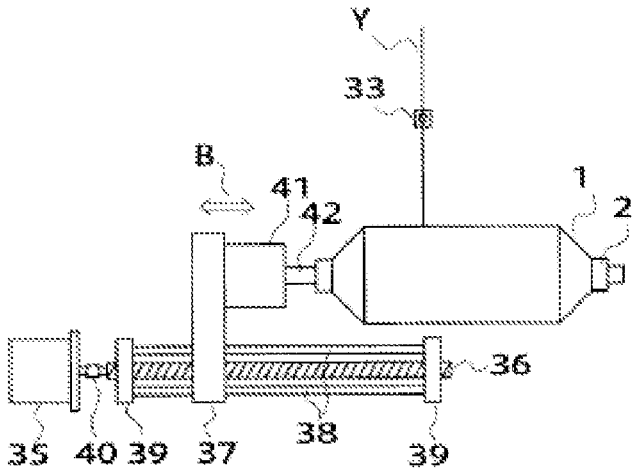
FIG. 5 is a schematic drawing showing the front of the filament winding device used in Example 1.

The filament winding device used was the filament winding device described in claim 5 of JP 2002-284447 A. In that filament winding device, the monofilament was continuously wound around a bobbin mounted on a spindle, while the monofilament was traversed alternately in both directions relatively to the bobbin axis direction by a servo mechanism, wherein the filament supply position was fixed, while the spindle was traversed alternately in both directions. Specifically, as shown in FIG. 5, a spindle (42) was connected with an induction motor (41) and a traverse drive device, and a bobbin (2) was mounted on the spindle (42). The supply position of the filament (Y) was fixed by a filament passage guide (33), and when the spindle (42) was driven to rotate by the induction motor (41) and was traversed in the bobbin axis direction by the traverse drive device, the filament (Y) was wound around the bobbin (2). As the drive source of the traverse drive device connected with the spindle (42), a servo motor (35) alternately rotating regularly and reversely was provided. The servo motor (35) was connected with a ball screw (36) via a coupling (40), and both the ends of the ball screw (36) were rotatably supported by brackets (39) via ball bearings (not shown in the drawing). The ball screw (36) was threadedly engaged with a ball nut (37), so that it could move in the axial direction, and the ball nut (37) was attached to the induction motor (41). The ball nut (37) was slidably supported by two guides (38) provided in parallel to the ball screw (36). Both the ends of the respective guides (38) were fixed to the brackets (39). When the servo motor (35) rotated regularly or reversely, the ball screw (36) rotated regularly or reversely, and in response to regular rotation or reverse rotation, the ball nut (37) alternately reciprocated in the axis direction of the ball screw (36). Therefore, the spindle (42) connected with the induction motor (41) on the ball nut traversed alternately in both directions in the axial direction of the bobbin (2), and the filament (Y) fixed in its supply position was wound around the bobbin (2). The traverse section in which the spindle traversed alternately in both directions like this was controlled to change during the winding of the filament (Y), to form a pirn-like package around the bobbin.

Example 2

A polyester monofilament package was obtained by the same method as that of Example 1, except that the surface speed of the take-up roll was changed to 1000 m/min, that the surface speed of the first hot roll was changed to 1010 m/min, that the surface speed of the second hot roll was changed to 3200 m/min, that the surface speed of the third hot roll was changed to 4000 m/min, that the surface speed of the godet roll was changed to 4000 m/min, and that the discharge amount from the metering pump was adjusted so that the fineness of the obtained monofilament might be 13 dtex.

Example 3

A polyester monofilament package was obtained by the same method as that of Example 1, except that the surface speed of the take-up roll was changed to 1100 m/min, that the surface speed of the first hot roll was changed to 1111 m/min, that the surface speed of the second hot roll was changed to 3280 m/min, that the surface speed of the third hot roll was changed to 4100 m/min, that the surface speed of the godet roll was changed to 4100 m/min, and that the discharge amount from the metering pump was adjusted so that the fineness of the obtained monofilament might be 13 dtex.

Example 4

So that a PET with an intrinsic viscosity (IV) of 0.78, polymerized and pelletized by conventional methods might be a core component and that a PET with an intrinsic viscosity (IV) of 0.51 and containing 0.3 wt % of titanium oxide, polymerized and pelletized by conventional methods, might be a sheath component, the respective PETs were molten by respectively different extruders.

Then, the molten polymers were passed through pipings in the spin block kept at a temperature of 295° C. and metering pumps for meting desired polymer flow rates and introduced into a spin pack. The spin pack was internally provided with filters and a known sheath-core conjugate spinneret. From the spinneret, a core-sheath type bicomponent structure filament was spun to achieve a core/sheath area ratio of 80/20. Then, in the same way as that of Example 1, the filament was passed through a heating cylinder, cooled by air, oiled and taken up by a take-up roll with a surface speed of 1200 m/min. Subsequently without being once wound, it was guided along a first hot roll with a surface temperature of 90° C. and with a surface speed of 1212 m/min, a second hot roll with a surface temperature of 90° C. and with a surface speed of 3930 m/min, a third hot roll with a surface temperature of 140° C. and with a surface speed of 4910 m/min and a godet roll with a surface speed of 4860 m/min, and then wound by the same filament winding device as that of Example 1. The obtained polyester monofilament package had a monofilament fineness of 8.0 dtex and was tapered at the end portions of the package with a taper angle of 40°, being 100 m in one traversing cycle filament length, 250 mm in the winding width of the innermost layer of the package, 75 mm in the winding diameter of the innermost layer of the package and 2.0 kg in the weight of the winding.

Example 5

A polyester monofilament package was obtained by the same method as that of Example 4, except that the surface speed of the second hot roll was changed to 3650 m/min, that the surface speed of the third hot roll was changed to 4560 m/min, that the surface speed of the godet roll was changed to 4510 m/min, and that the discharge amounts from the metering pumps were adjusted so that the fineness of the obtained monofilament might be 8.0 dtex.

Example 6

A polyester monofilament package was obtained by the same method as that of Example 4, except that the intrinsic viscosity (IV) of the PET as the core component was 1.00, that the surface speed of the take-up roll was changed to 1000 m/min, that the surface speed of the first hot roll was changed to 1010 m/min, the surface speed of the second hot roll was changed to 3150 m/min, that the surface temperature and the surface speed of the third hot roll were changed to 200° C. and 4500 m/min respectively, that the surface speed of the godet roll was changed to 4450 m/min, and that the discharge amounts from the metering pumps were adjusted so that the fineness of the obtained monofilament might be 8 dtex.

Example 7

A polyester monofilament package was obtained by the same method as that of Example 4, except that the surface speed of the take-up roll was changed to 500 m/min, that the surface speed of the first hot roll was changed to 505 m/min, that the surface speed of the second hot roll was changed to 1800 m/min, that the surface speed of the third hot roll was changed to 2850 m/in, that the surface speed of the godet roll was changed to 2850 m/min, and that the discharge amounts from the metering pumps were adjusted so that the fineness of the obtained monofilament might be 5 dtex.

(Evaluation of Examples 1 to 7)

The results of Examples 1 to 7 are shown in Table 1. In the comparison among Examples 1 to 3 and in the comparison among Examples 4 to 6, a monofilament with a higher modulus was found to assure higher printing precision, and a monofilament smaller in fineness allowed finer lines to be reproduced. Since the monofilament of Example 7 had the smallest fineness and a high modulus, it had very good printing precision though the unraveling tension variation gradient and the inner layer shrinkage stress variation were rather large, causing the obtained mesh woven fabric to have slight barre/weaving bars.

TABLE 1

| | | Example 1 | Example 2 | Example 3 | Example 4 | Example 5 | Example 6 | Example 7 |
|---|---|---|---|---|---|---|---|---|
| Single component or core-sheath | | Single component | Single component | Single component | Core-sheath | Core-sheath | Core-sheath | Core-sheath |
| Fineness | dtex | 13 | 13 | 13 | 8 | 8 | 8 | 5 |
| Strength | cN/dtex | 5.9 | 5.6 | 5.3 | 6.3 | 5.8 | 7.5 | 8.6 |
| 10% modulus | cN/dtex | 4.3 | 3.8 | 3.4 | 5.4 | 4.5 | 6.8 | 8.0 |
| Coefficient of dynamic friction between filament and filament | μd | 0.09 | 0.09 | 0.09 | 0.10 | 0.10 | 0.11 | 0.11 |
| Residual torque | count/m | 1 | 1 | 1 | 1 | 1 | 1 | 1 |
| Winding diameter of the innermost layer | mm | 75 | 75 | 75 | 75 | 75 | 75 | 75 |
| Winding width of the innermost layer | mm | 250 | 250 | 250 | 250 | 250 | 250 | 250 |
| One traversing cycle filament length | m | 100 | 100 | 100 | 100 | 100 | 100 | 100 |
| Taper angle | ° | 40 | 40 | 40 | 40 | 40 | 40 | 40 |
| Winding tension | cN/dtex | 0.2 | 0.2 | 0.2 | 0.2 | 0.2 | 0.2 | 0.2 |
| Unraveling tension variation gradient | cN/(dtex · m) | 0.004 | 0.003 | 0.003 | 0.008 | 0.006 | 0.009 | 0.013 |
| Wet heat shrinkage stress variation | cN/dtex | 0.6 | 0.4 | 0.3 | 0.9 | 0.7 | 1.6 | 2.2 |
| Fiber falling from package | | B | A | A | A | A | A | A |
| Unraveling capability | | B | B | B | B | B | B | B |
| Weft weaving bars, barre | | A | A | A | B | A | B | C |
| Shaving fluff | | B | A | A | A | B | B | B |
| Printing | Line width | 200 μm | 200 μm | 200 μm | 100 μm | 100 μm | 100 μm | 100 μm |
| | Evaluation | A | B | C | B | C | B | A |

Example 8

A polyester monofilament package was obtained by the same method as that of Example 1, except that the amount of the deposited oil was adjusted to 0.1% based on the amount of the stretched monofilament.

Comparative Example 1

A polyester monofilament package was obtained by the same method as that of Example 8, except that the amount of the water soluble polyether-modified silicone in the oil was 0%.

Examples 9 and 10 and Comparative Example 2

Polyester monofilament packages were obtained by the same method as that of Example 4, except that the taper angle was changed as shown in Table 2.

Comparative Example 3

A polyester monofilament package was obtained by the same method as that of Comparative Example 1, except that the taper angle was changed as shown in Table 2.

(Evaluation of Examples 8 to 10 and Comparative Examples 1 to 3)

The results of Examples 8 to 10 and Comparative Examples 1 to 3 are shown in Table 2. In Example 8 and Comparative Example 1, when the coefficient of dynamic friction between filament and filament increased, the shaving fluff during weaving tended to increase, and in Comparative Example 1, defects occurred frequently to show poor quality. In Examples 9 and 10 and Comparative Example 2, when the taper angle increased, the fiber falling tended to easily occur. In Comparative Example 2, unraveling filament breakage occurred frequently. Further, in Comparative Example 3 where both the coefficient of dynamic friction between filament and filament and the taper angle were large, winding could be performed without fiber falling, but shaving fluff occurred frequently during weaving.

TABLE 2

| | | Example 8 | Comparative Example 1 | Example 9 | Example 10 | Comparative Example 2 | Comparative Example 3 |
|---|---|---|---|---|---|---|---|
| Single component or core-sheath | | Single component | Single component | Core-sheath | Core-sheath | Core-sheath | Core-sheath |
| Fineness | dtex | 13 | 13 | 8 | 8 | 8 | 13 |
| Strength | cN/dtex | 5.9 | 5.9 | 6.3 | 6.3 | 6.3 | 5.9 |
| 10% modulus | cN/dtex | 4.3 | 4.3 | 5.4 | 5.4 | 5.4 | 4.3 |
| Coefficient of dynamic friction between filament and filament | μd | 0.12 | 0.15 | 0.09 | 0.09 | 0.09 | 0.15 |
| Residual torque | count/m | 1 | 1 | 1 | 1 | 1 | 1 |
| Winding diameter of the innermost layer | mm | 75 | 75 | 75 | 75 | 75 | 75 |
| Winding width of the innermost layer | mm | 250 | 250 | 250 | 250 | 250 | 250 |
| One traversing cycle filament length | m | 100 | 100 | 100 | 100 | 100 | 100 |
| Taper angle | ° | 40 | 40 | 55 | 70 | 80 | 80 |
| Winding tension | cN/dtex | 0.2 | 0.2 | 0.2 | 0.2 | 0.2 | 0.2 |
| Unraveling tension variation gradient | cN/(dtex · m) | 0.008 | 0.012 | 0.008 | 0.008 | 0.007 | 0.012 |
| Wet heat shrinkage stress variation | cN/dtex | 0.6 | 0.7 | 0.9 | 0.9 | 1.0 | 0.6 |
| Fiber falling from package | | A | A | B | C | D | B |
| Unraveling capability | | B | B | B | C | D | B |
| Weft weaving bars, barre | | B | C | B | B | — | C |
| Shaving fluff | | C | D | A | A | — | D |

Examples 11 to 14 and Comparative Example 4

Polyester monofilament packages were obtained by the same method as that of Example 1, except that the alternate bi-directional traversing speed and the traverse width of the filament winding device were adjusted to change the one traversing cycle filament length and the winding width of the innermost layer as shown in Table 3.

Example 15

A polyester monofilament package was obtained by the same method as that of Example 3, except that the alternate bi-directional traversing speed and the traverse width of the filament winding device were adjusted to change the one traversing cycle filament length and the winding width of the innermost layer as shown in Table 3.

Example 16

A polyester monofilament package was obtained by the same method as that of Example 4, except that the alternate bi-directional traversing speed of the filament winding device was adjusted to change the one traversing cycle filament length as shown in Table 3.

Comparative Example 5

A polyester monofilament package was obtained by the same method as that of Example 7, except that the alternate bi-directional traversing speed of the filament winding device was adjusted to change the one traversing cycle filament length as shown in Table 3.

(Evaluation of Examples 11 to 16 and Comparative Examples 4 and 5)

The results of Examples 11 to 16 and Comparative Examples 4 and 5 are shown in Table 3. In Examples 11 to 14 and Comparative Example 4, when the one traversing cycle filament length was longer while the winding width of the innermost layer was smaller, the unraveling tension variation gradient was smaller and the barre/weaving bars as appearance quality of the mesh woven fabric tended to be better. In Comparative Example 4, significant barre/weaving bars occurred frequently. In Examples 12 and 16 and Comparative Example 5, the unraveling tension variation gradient was likely to be larger at a smaller fineness/higher modulus even though the winding form remained the same. In Comparative Example 5, significant barre/weaving bars occurred.

TABLE 3

| | | Example 11 | Example 12 | Example 13 | Example 14 | Comparative Example 4 | Example 15 | Example 16 | Comparative Example 5 |
|---|---|---|---|---|---|---|---|---|---|
| Single component or core-sheath | | Single component | Single component | Single component | Single component | Single component | Single component | Core-sheath | Core-sheath |
| Fineness | dtex | 13 | 13 | 13 | 13 | 13 | 13 | 8 | 5 |
| Strength | cN/dtex | 5.9 | 5.9 | 5.9 | 5.9 | 5.9 | 5.3 | 6.3 | 8.6 |
| 10% modulus | cN/dtex | 4.3 | 4.3 | 4.3 | 4.3 | 4.3 | 3.4 | 5.4 | 8.0 |
| Coefficient of dynamic friction between filament and filament | μd | 0.09 | 0.09 | 0.09 | 0.09 | 0.09 | 0.09 | 0.10 | 0.11 |
| Residual torque | count/m | 1 | 1 | 1 | 1 | 1 | 1 | 1 | 1 |
| Winding diameter of the innermost layer | mm | 75 | 75 | 75 | 75 | 75 | 75 | 75 | 75 |
| Winding width of the innermost layer | mm | 250 | 250 | 350 | 450 | 450 | 450 | 250 | 250 |
| One traversing cycle filament length | m | 20 | 50 | 100 | 100 | 20 | 20 | 50 | 50 |
| Taper angle | ° | 40 | 40 | 40 | 40 | 40 | 40 | 40 | 40 |
| Winding tension | cN/dtex | 0.2 | 0.2 | 0.2 | 0.2 | 0.2 | 0.2 | 0.2 | 0.2 |
| Unraveling tension variation gradient | cN/(dtex · m) | 0.012 | 0.007 | 0.008 | 0.013 | 0.025 | 0.018 | 0.015 | 0.026 |
| Wet heat shrinkage stress variation | cN/dtex | 0.6 | 0.6 | 0.6 | 0.6 | 0.6 | 0.6 | 0.9 | 2.2 |
| Fiber falling from package | | A | A | A | A | A | A | A | A |
| Unraveling capability | | B | B | B | B | B | B | B | B |
| Weft weaving bars, barre | | C | B | B | C | D | C | B | C |

Examples 17 and 18

Polyester monofilament packages were obtained by the same method as that of Example 1, except that the winding diameter of the innermost layer of the package was changed as shown in Table 4.

Example 19 and Comparative Example 6

Polyester monofilament packages were obtained by the same method as that of Example 4, except that the winding diameter of the innermost layer of the package was changed as shown in Table 4.

Comparative Example 7

A polyester monofilament package was obtained by the same method as that of Example 7, except that the winding diameter of the innermost layer of the package was changed as shown in Table 4.

(Evaluation of Examples 17 to 19 and Comparative Examples 6 and 7)

The results of Examples 17 to 19 and Comparative Examples 6 and 7 are shown in Table 4. In the comparison of them, a package smaller in the winding diameter of the innermost layer and smaller in fineness/higher in modulus was larger in the inner layer shrinkage stress variation. In the mesh woven fabrics of Comparative Examples 6 and 7, significant bane occurred.

TABLE 4

| | | Example 17 | Example 18 | Example 19 | Comparative Example 6 | Comparative Example 7 |
|---|---|---|---|---|---|---|
| Single component or core-sheath | | Single component | Single component | Core-sheath | Core-sheath | Core-sheath |
| Fineness | dtex | 13 | 13 | 8 | 8 | 5 |
| Strength | cN/dtex | 5.9 | 5.9 | 6.3 | 6.3 | 8.6 |
| 10% modulus | cN/dtex | 4.3 | 4.3 | 5.4 | 5.4 | 8.0 |
| Coefficient of dynamic friction between filament and filament | μd | 0.09 | 0.09 | 0.10 | 0.10 | 0.11 |
| Residual torque | count/m | 1 | 1 | 1 | 1 | 1 |
| Winding diameter of the innermost layer | mm | 52 | 40 | 52 | 40 | 40 |
| Winding width of the innermost layer | mm | 250 | 250 | 250 | 250 | 250 |
| One traversing cycle filament length | m | 100 | 100 | 100 | 100 | 100 |
| Taper angle | ° | 40 | 40 | 40 | 40 | 40 |
| Winding tension | cN/dtex | 0.2 | 0.2 | 0.2 | 0.2 | 0.2 |
| Unraveling tension variation gradient | cN/(dtex · m) | 0.004 | 0.004 | 0.008 | 0.009 | 0.014 |
| Wet heat shrinkage stress variation | cN/dtex | 1.3 | 1.8 | 1.9 | 3.2 | 3.8 |
| Fiber falling from package | | B | C | B | B | A |
| Unraveling capability | | B | C | B | C | B |
| Weft weaving bars, barre | | B | C | C | D | C |

Examples 20 and 21

Polyester monofilament packages were obtained by the same method as that of Example 1, except that the winding tension was changed as shown in table 5.

Comparative Example 8

A polyester monofilament package was obtained by the same method as that of Example 4, except that the winding tension was changed as shown in Table 5.

Comparative Example 9

A polyester monofilament package was obtained by the same method as that of Example 7, except that the winding tension was changed as shown in Table 5.

(Evaluation of Examples 20 and 21 and Comparative Examples 8 and 9)

The results of Examples 20 and 21 and Comparative Examples 8 and 9 are shown in Table 5. In the comparison, a package higher in winding tension was larger in the inner layer shrinkage stress variation, and a package smaller in fineness/higher in modulus was more remarkable in the inner layer shrinkage stress variation. In Comparative Examples 8 and 9, significant barre/weaving bars occurred.

TABLE 5

| | | Example 20 | Example 21 | Comparative Example 8 | Comparative Example 9 |
|---|---|---|---|---|---|
| Single component or core-sheath | | Single component | Single component | Core-sheath | Core-sheath |
| Fineness | dtex | 13 | 13 | 8 | 5 |
| Strength | cN/dtex | 5.9 | 5.9 | 6.3 | 8.6 |
| 10% modulus | cN/dtex | 4.3 | 4.3 | 5.4 | 8.0 |
| Coefficient of dynamic friction between filament and filament | μd | 0.09 | 0.09 | 0.10 | 0.11 |
| Residual torque | count/m | 1 | 1 | 1 | 1 |
| Winding diameter of the innermost layer | mm | 75 | 75 | 75 | 75 |
| Winding width of the innermost layer | mm | 250 | 250 | 250 | 250 |
| One traversing cycle filament length | m | 100 | 100 | 100 | 100 |
| Taper angle | ° | 40 | 40 | 40 | 40 |
| Winding tension | cN/dtex | 0.4 | 0.6 | 0.6 | 0.4 |
| Unraveling tension variation gradient | cN/(dtex · m) | 0.004 | 0.004 | 0.008 | 0.013 |
| Wet heat shrinkage stress variation | cN/dtex | 1.4 | 2.0 | 3.3 | 3.9 |

TABLE 5-continued

| | Example 20 | Example 21 | Comparative Example 8 | Comparative Example 9 |
|---|---|---|---|---|
| Fiber falling from package | B | C | A | A |
| Unraveling capability | B | C | B | B |
| Weft weaving bars, barre | C | C | D | D |

Example 22

Figure 6:
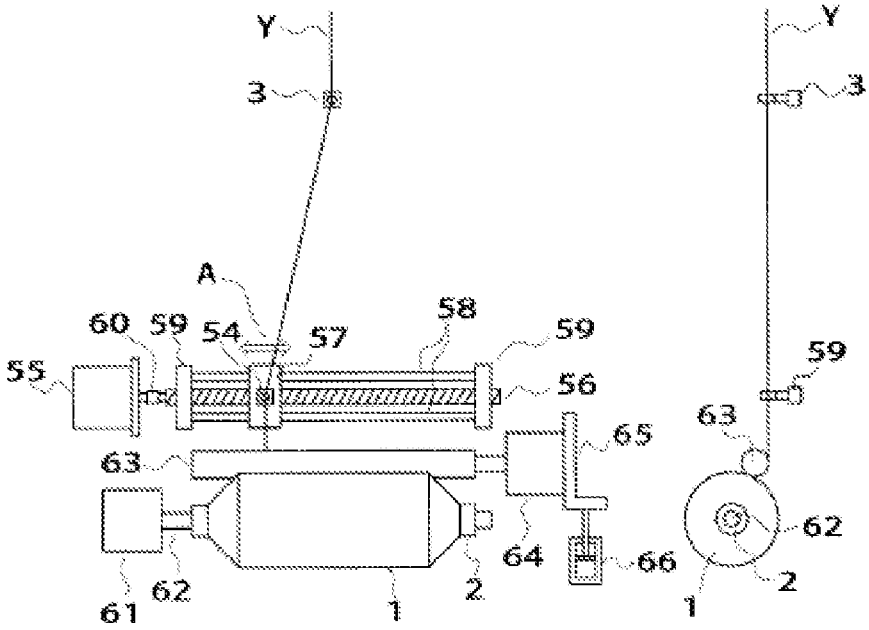
FIG. 6 is a schematic drawing showing the front and right side of the filament winding device used in Example 22.

A polyester monofilament package was obtained by the same method as that of Example 1, except that the filament winding device was changed to wind while a roller bail with a rotating axis almost parallel to the rotating axis of the bobbin was pressed to the surface of the package during winding. The filament winding device used was the filament winding device described in claim 4 of JP 2002-284447 A, specifically the filament winding device shown in FIG. 6. As shown in FIG. 6, a spindle (62) was connected with an induction motor (61), and a bobbin (2) was mounted on the spindle (62). When the spindle (62) was driven to rotate by the induction motor (61), the filament (Y) was wound around the bobbin (2), being guided by a traverse guide (54). On the other hand, as the drive source of the traverse drive device of the abovementioned traverse guide (54), a servo motor (55) for alternately rotating regularly and reversely was provided. A ball screw (56) was connected with the servo motor (55) via a coupling (60), and both the ends of the ball screw (56) were supported by brackets (59) via ball bearings (not shown on the drawing). The ball screw (56) was threadedly engaged with a ball nut (57) so that it could move in the axial direction, and the traverse guide (54) was attached to the ball nut (57). The ball nut (57) was slidably supported by two guides (58) provided in parallel to the ball screw (56). Both the ends of the respective guides (58) were fixed to brackets (59). When the servo motor (55) rotated regularly or reversely, the ball screw (56) rotated regularly or reversely, and in response to regular rotation or reverse rotation, the ball nut (57) alternately reciprocated in the axial direction of the ball screw (56). Therefore, while the filament (Y) was guided by the traverse guide (54) on the ball nut (57), the filament was wound around the bobbin (2). The traverse section in which the filament (Y) traversed alternately in both directions like this was controlled to change during the winding of the filament (Y), to form a pirn-like package around the bobbin (2).

In the meantime, a roller bail (63) having a rotating axis almost parallel to the rotating axis of the bobbin was provided between the traverse guide (54) and the package, to press the surface of the package during winding. An induction motor (64) was connected with the roller bail (63) separately from the induction motor (61) used for driving the rotation of the spindle (62), and an air cylinder (66) was attached to a bracket (65) connected with the induction motor (64). The air cylinder was driven by a fluid, and the pressure of the fluid was adjusted by a pressure reducing valve (not shown in the drawing), to adjust the pressing pressure per unit length of the contact length between the surface of the package and the roller bail (63).

Meanwhile, in this filament winding device, the fluid pressure for driving the air cylinder (66) was adjusted every five minutes to ensure that the pressing pressure by the roller bail (63) to the package might be 50±3 gf/m in the period from the start of winding to the end of winding. Further, the surface speed of the roller bail (63) was set at 1.05 times the surface speed of the package.

Example 23

A polyester monofilament package was obtained by the same method as that of Example 4, except that the filament winding device of Example 22 was used.

Comparative Example 10

A polyester monofilament package was obtained by the same method as that of Example 7, except that the filament winding device of Example 22 was used.

(Evaluation of Examples 22 and 23 and Comparative Example 10)

The results of Examples 22 and 23 and Comparative Example 10 are shown in Table 6. As the winding type, guided traversing with a roller bail was employed, and the inner layer shrinkage stress variation tended to be large. In Comparative Example 10, significant barre/weaving bars occurred in the mesh woven fabric.

TABLE 6

| | | Example 22 | Example 23 | Comparative Example 10 |
|---|---|---|---|---|
| Single component or core-sheath | | Single component | Core-sheath | Core-sheath |
| Fineness | dtex | 13 | 8 | 5 |
| Strength | cN/dtex | 5.9 | 6.3 | 8.6 |
| 10% modulus | cN/dtex | 4.3 | 5.4 | 8.0 |
| Coefficient of dynamic friction between filament and filament | μd | 0.09 | 0.10 | 0.11 |
| Residual torque | count/m | 1 | 1 | 1 |
| Winding diameter of the innermost layer | mm | 75 | 75 | 75 |
| Winding width of the innermost layer | mm | 250 | 250 | 250 |
| One traversing cycle filament length | m | 100 | 100 | 100 |
| Taper angle | ° | 40 | 40 | 40 |
| Winding tension | cN/dtex | 0.2 | 0.2 | 0.2 |
| Winder type | | Guided traversing with roller bail | | |
| Unraveling tension variation gradient | cN/(dtex · m) | 0.004 | 0.008 | 0.013 |
| Wet heat shrinkage stress variation | cN/dtex | 1.2 | 2.1 | 3.5 |
| Fiber falling from package | | C | B | B |
| Unraveling capability | | C | C | C |
| Weft weaving bars, barre | | B | C | D |

Example 24

The processing from oiling to taking up was performed by the same method as that of Example 1, and the non-stretched monofilament was once wound. Then, it was stretched and wound by a stretching machine consisting of a filament supply roll, first, second and third hot rolls, cold roll and draw twister type winding machine, to obtain a polyester monofilament package. The detailed conditions in this case were as follows:

First hot roll: Temperature 90° C., surface speed 138 m/min

Second hot roll: Temperature 90° C., surface speed 484 m/min

Third hot roll: Temperature 140° C., surface speed 600 m/min

Cold roll: Room temperature, surface speed 600 m/min

Draw twister: Spindle speed 8000 rpm, tension at outlet of cold roll 0.2 cN/dtex Example 25

The processing from oiling to taking up was performed by the same method as that of Example 4, and the non-stretched monofilament was once wound. Then, it was stretched and wound by the stretching machine of Example 24, to obtain a polyester monofilament package. The detailed conditions in this case were as follows:

First hot roll: Temperature 90° C., surface speed 151 m/min

Second hot roll: Temperature 90° C., surface speed 485 m/min

Third hot roll: Temperature 140° C., surface speed 606 m/min

Cold roll: Room temperature, surface speed 600 m/min

Draw twister: Spindle speed 8000 rpm, tension at outlet of cold roll 0.2 cN/dtex Example 26

The processing from oiling to taking up was performed by the same method as that of Example 4, and the non-stretched monofilament was once wound. Then, it was stretched and wound by the stretching machine of Example 24, to obtain a polyester monofilament package. The detailed conditions in this case were as follows:

First hot roll: Temperature 90° C., surface speed 106 m/min

Second hot roll: Temperature 90° C., surface speed 379 m/min

Third hot roll: Temperature 200° C., surface speed 600 m/min

Cold roll: Room temperature, surface speed 600 m/min

Draw twister: Spindle speed 8000 rpm, tension at outlet of cold roll 0.2 cN/dtex (Evaluation of Examples 24 to 26)

The results of Examples 24 to 26 are shown in Table 7. In all of Examples 24 to 26, the residual torque was large, and especially when the fineness was smaller, the filament deviation during unraveling tended to easily occur.

TABLE 7

| | | Example 24 | Example 25 | Example 26 |
|---|---|---|---|---|
| Single component or core-sheath | | Single component | Core-sheath | Core-sheath |
| Fineness | dtex | 13 | 8 | 5 |
| Strength | cN/dtex | 5.9 | 6.3 | 8.5 |
| 10% modulus | cN/dtex | 4.3 | 5.4 | 7.9 |
| Coefficient of dynamic friction between filament and filament | μd | 0.09 | 0.09 | 0.11 |
| Residual torque | count/m | 5 | 5 | 5 |
| Winding diameter of the innermost layer | mm | 52 | 52 | 52 |
| Winding width of the innermost layer | mm | 250 | 250 | 250 |
| One traversing cycle filament length | m | 100 | 100 | 100 |
| Taper angle | ° | 40 | 40 | 40 |
| Winding tension | cN/dtex | 0.2 | 0.2 | 0.2 |

TABLE 7-continued

| | | Example 24 | Example 25 | Example 26 |
|---|---|---|---|---|
| Winder type | | Ring twister set | | |
| Unraveling tension variation gradient | cN/(dtex · m) | 0.005 | 0.009 | 0.015 |
| Wet heat shrinkage stress variation | cN/dtex | 1.3 | 2.1 | 2.8 |
| Fiber falling from package | | B | A | A |
| Unraveling capability | | B | C | C |
| Weft weaving bars, barre | | A | B | C |

The invention claimed is:

1. A polyester monofilament package wherein a polyester monofilament comprising polyethylene terephthalate is wound, which satisfies all of (a) to (d):

(a) a coefficient of dynamic friction between filament and filament of the polyester monofilament is 0.13 μd or lower;

(b) end portions of the package are tapered with a taper angle of 75° or smaller;

(c) unraveling tension variation gradient ΔT is 0.02 cN/(dtex·m) or smaller; and (d) wet heat shrinkage stress variation of the polyester monofilament in a 1 mm winding thickness portion of an inner layer of the package is 3.0 cN/dtex or smaller.

2. The polyester monofilament package according to claim 1, which satisfies at least one of (e) to (h):

(e) filament length wound per one traversing cycle is 25 m or longer;

(f) winding width of an innermost layer of the package is 150 to 300 mm;

(g) winding diameter of the innermost layer of the package is 75 to 200 mm; and (h) residual torque of wound polyester monofilament is 4 count/m or less.

3. The polyester monofilament package according to claim 2, which satisfies (i):

(i) wet heat shrinkage stress variation of the polyester monofilament in the 1 mm winding thickness portion of the inner layer of the package is 0.3 cN/dtex or smaller.

4. The polyester monofilament package according to claim 2, wherein wound polyester monofilament satisfies at least one of (j) and (k):

(j) fineness is 3 to 40 dtex; and (k) stress at 10% elongation (10% modulus) is 3.6 cN/dtex or higher.

5. The polyester monofilament package according to claim 2, wherein the wound polyester monofilament satisfies (l):

(l) the polyester monofilament is a core-sheath type bicomponent structure filament and both core and sheath components are polyethylene terephthalate.

6. The polyester monofilament package according to claim 2, wherein wound polyester monofilament satisfies (o):

(o) fineness is 3 to 18 dtex.

7. The polyester monofilament package according to claim 1, which satisfies (i):

(i) wet heat shrinkage stress variation of the polyester monofilament in the 1 mm winding thickness portion of the inner layer of the package is 0.3 cN/dtex or smaller.

8. The polyester monofilament package according to claim 7, wherein wound polyester monofilament satisfies at least one of (j) and (k):

(j) fineness is 3 to 40 dtex; and (k) stress at 10% elongation (10% modulus) is 3.6 cN/dtex or higher.

9. The polyester monofilament package according to claim 7, wherein the wound polyester monofilament satisfies (l):

(l) the polyester monofilament is a core-sheath type bicomponent structure filament and both core and sheath components are polyethylene terephthalate.

10. The polyester monofilament package according to claim 7, wherein wound polyester monofilament satisfies (o):

(o) fineness is 3 to 18 dtex.

11. The polyester monofilament package according to claim 1, wherein wound polyester monofilament satisfies at least one of (j) and (k):

(j) fineness is 3 to 40 dtex; and (k) stress at 10% elongation (10% modulus) is 3.6 cN/dtex or higher.

12. The polyester monofilament package according to claim 11, wherein the wound polyester monofilament satisfies (l):

(l) the polyester monofilament is a core-sheath type bicomponent structure filament and both core and sheath components are polyethylene terephthalate.

13. The polyester monofilament package according to claim 11, wherein wound polyester monofilament satisfies (o):

(o) fineness is 3 to 18 dtex.

14. The polyester monofilament package according to claim 1, wherein the wound polyester monofilament satisfies (l):

(l) the polyester monofilament is a core-sheath type bicomponent structure filament and both core and sheath components are polyethylene terephthalate.

15. The polyester monofilament package according to claim 14, wherein wound polyester monofilament satisfies (m) and (n):

(m) intrinsic viscosity (IV) of the core component is 0.70 or higher, and intrinsic viscosity of the sheath component is 0.4 or higher and is lower than the intrinsic viscosity of the core component by 0.2 or more; and (n) 10% modulus is 5.0 cN/dtex or higher.

16. The polyester monofilament package according to claim 15, wherein wound polyester monofilament satisfies (o):

(o) fineness is 3 to 18 dtex.

17. The polyester monofilament package according to claim 14, wherein wound polyester monofilament satisfies (o):

(o) fineness is 3 to 18 dtex.

18. The polyester monofilament package according to claim 1, wherein wound polyester monofilament satisfies (o):

(o) fineness is 3 to 18 dtex.

* * * * *

UNITED STATES PATENT AND TRADEMARK OFFICE

CERTIFICATE OF CORRECTION

PATENT NO. : 8,398,010 B2
APPLICATION NO. : 13/521380
DATED : March 19, 2013
INVENTOR(S) : Tomita et al.

It is certified that error appears in the above-identified patent and that said Letters Patent is hereby corrected as shown below:

In the Specifications

In Column 20

At line 67, please change “bane” to -- barre --.

Signed and Sealed this
Ninth Day of July, 2013

Teresa Stanek Rea
*Acting Director of the United States Patent and Trademark Office*